US008341996B2

(12) United States Patent
Hallfeldt et al.

(10) Patent No.: US 8,341,996 B2
(45) Date of Patent: Jan. 1, 2013

(54) METHOD AND DEEP-DRAWING APPARATUS FOR THE DEEP DRAWING OF METAL SHEETS

(75) Inventors: Torsten Hallfeldt, Eschweiler (DE); Raymund Pflitsch, Engelskirchen (DE); Carsten Greisert, Augsburg (DE); Juergen Wesemann, Wurselen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 996 days.

(21) Appl. No.: 12/161,913

(22) PCT Filed: Jan. 16, 2007

(86) PCT No.: PCT/EP2007/050372

§ 371 (c)(1), (2), (4) Date: Dec. 23, 2008

(87) PCT Pub. No.: WO2007/085550

PCT Pub. Date: Aug. 2, 2007

(65) Prior Publication Data

US 2009/0301163 A1 Dec. 10, 2009

(30) Foreign Application Priority Data

Jan. 24, 2006 (DE) ..... 10 2006 003 268

(51) Int. Cl.
*B21D 22/00* (2006.01)

(52) U.S. Cl. ..... 72/350; 72/351; 72/359; 72/453.13

(58) Field of Classification Search ..... 72/347, 72/348, 350, 351, 359, 379.2, 453.13, 702
See application file for complete search history.

(56) References Cited

U.S. PATENT DOCUMENTS

| | | | | |
|---|---|---|---|---|
| 5,901,599 | A * | 5/1999 | Sato et al. | 72/350 |
| 6,276,185 | B1 * | 8/2001 | Owens | 72/350 |
| 7,237,423 | B1 * | 7/2007 | Nagel et al. | 72/350 |
| 7,861,568 | B2 * | 1/2011 | Nakamura et al. | 72/350 |

* cited by examiner

*Primary Examiner* — David B Jones
(74) *Attorney, Agent, or Firm* — Tung & Associates; Raymond L. Coppiellie

(57) ABSTRACT

A method and a deep-drawing apparatus for the deep drawing of a metal sheet by means of a press, a table, a drawing punch, and also a drawing die and a counterpressure plate interacting with the drawing die, which together form a flow path for the metal sheet, wherein at least one drawing strip movable relative to the counterpressure plate is pushed transversely through the flow path of the metal sheet in order to deflect the metal sheet during a drawing phase (first deflection phase) and the drawing strip, for a stop phase, is pushed by a further short distance transversely through the flow path (F) (second deflection stage), wherein a deflection increased once again inhibits the flow of the metal sheet during the second deflection stage, and wherein the metal sheet is essentially plastically formed at the end of the deep-drawing operation, wherein the degree of deflection required during the first deflection stage is set by means of an interchangeable distance piece which is arranged between the counterpressure plate and the drawing strip and serves as a limit stop. Independently thereof, the degree of deflection required during the second deflection stage can be set by further distance elements which are arranged between the table and the drawing strips.

9 Claims, 12 Drawing Sheets

METHOD AND DEEP-DRAWING APPARATUS FOR THE DEEP DRAWING OF METAL SHEETS

CROSS-REFERENCE TO RELATED APPLICATIONS

This application claims the benefit of PCT Application Serial No. PCT/EP2007/050372 filed Jan. 16, 2007, which claims benefit the benefit of German Application Serial No. DE102006003268.3 filed Jan. 24, 2006.

FEDERALLY SPONSORED RESEARCH OR DEVELOPMENT

Not Applicable

REFERENCE TO A SEQUENCE LISTING

Not Applicable

BACKGROUND OF THE INVENTION

1. Field of the Invention

The invention relates to a method for the deep drawing of a metal sheet by means of a press, a table, a drawing punch, and also a drawing die and a counterpressure plate interacting with the drawing die, which together form a flow path for the metal sheet, wherein at least one drawing strip movable relative to the counterpressure plate is pushed transversely through the flow path of the metal sheet in order to deflect the metal sheet during a drawing phase (first deflection phase) and the drawing strip, for a stop phase, is pushed by a further short distance transversely through the flow path (second deflection stage), wherein a deflection increased once again inhibits the flow of the metal sheet during the second deflection stage, and wherein the metal sheet is essentially plastically formed at the end of the deep-drawing operation.

The flow path is a drawing gap formed between a drawing die and counterpressure plate. The metal sheet slips through this drawing gap, in the course of which it is inhibited by the pressure of the counterpressure plate.

The invention also relates to a deep-drawing apparatus for metal sheets, comprising a table, a drawing punch, a press, a drawing die, a counterpressure plate, a plurality of drawing strips which are mounted in the counterpressure plate such as to be movable parallel to the press direction of the press, and drawing grooves which are provided at the margin of the drawing die and into which the drawing strips can be moved step by step while maintaining a drawing gap, a drawing phase being provided for the purpose of step-by-step forming of the metal sheet, during which the drawing phase of the metal sheet is given a drawing bead having a small bead depth, and at least one stop phase being provided, during which the metal sheet is given a stop bead which has a larger bead depth than the drawing bead.

Normally used for the production of car body parts are very large mechanical or hydraulic presses with counterholding devices which essentially have to ensure exact adjustability of the press force and counterholding force, since different drawn parts require different press forces and counterholding forces. The counterholding devices can be designed in a wide variety of ways; in this case the counterholding force is preferably applied hydraulically or by spring force.

The press and the counterholding device deliver the forces which are required for the forming. In addition, a deep-drawing apparatus is required which has individual forming tools, such as a drawing punch, drawing die and individual devices for controlling the material flow.

2. Description of Related Art

A method of the generic type for the deep drawing of metal sheets and a deep-drawing apparatus are known from U.S. Pat. No. 6,276,185 B1. In this case, the material flow is controlled by two drawing strips which are arranged symmetrically relative to a drawing punch. The drawing strips are pushed transversely into the flow path of the metal sheet in order to meter the material flow. This first deflection stage is maintained until the bottom ends of the drawing strips, which project freely from the counterpressure plate, strike a table. Starting from this instant, the drawing strips are pushed further through the flow path of the metal sheet, as a result of which the flow process is further inhibited.

A disadvantage of this prior art is the lack of variability of the deep-drawing apparatus. The known deep-drawing apparatus can be changed over or set only in a very complicated manner if the adjustment of the setting becomes necessary.

Another deep-drawing apparatus is known from German Patent No. DE 199 53 751 A1. Said deep-drawing apparatus proposes drawing strips which are to be moved via mechanical transmissions or hydraulic circuits, although provision is not made for the drawing strips to be moved in two steps transversely through the flow path for a drawing phase and a stop phase. The measures known from German Patent No. DE 199 53 751 A1 for driving the drawing strips are complicated and susceptible to damage and therefore appear to be less suitable in particular for mass production, as in the automobile industry for example.

The object of the invention is to propose a method for the deep drawing of metal sheets which ensures an exact consistent deflection of the flow path of the metal sheet during the drawing phase, great importance being attached to simple and quick adjustability in order to vary the degree of deflection if a fine adjustment, i.e. in the event of wear of the tool or when the material characteristics are changed, becomes necessary.

BRIEF SUMMARY OF THE INVENTION

According to the invention, the object is achieved by a method in which the degree of deflection required during the first deflection stage is set by means of an interchangeable distance piece which is arranged between the counterpressure plate and the drawing strip and serves as a limit stop.

Drawing strips are normally arranged in sections around a metal sheet and form a type of frame which controls the drawing movement of the metal sheet. According to the novel method, the extent to which the drawing strip projects into the flow path of the metal sheet is set by a fixed limit stop. Since the distance piece can be exchanged very easily, the distance piece can be changed if the drawing strip is required to cross the flow path of the metal sheet to a different extent.

The customary fluctuation of the material characteristics of deep-drawn sheets or the deliberate change in the material characteristics can thus be compensated for in a simple manner. With the invention, a fine adjustment of the deep-drawing tool can be carried out even when pressing out a charge, as a rule a steel coil, since the amount of time required is small and production stoppage is therefore kept within limits. But even if resetting is necessary, since, for example, another deep-drawn part made of a different material is to be produced in the same deep-drawing tool, for example a different, firmer or softer grade of steel, the deep-drawing tool can be changed over quickly and simply. This is important in particular in the platform strategy in automobile companies, where different vehicles are constructed on the same platform, i.e. the shape of the corresponding deep-drawn parts is identical, whereas the deep-drawn parts are adapted to the respective vehicle from the strength point of view by the selection of different materials. In particular the great number of various high-strength steels should be mentioned here.

Within the scope of the invention, the drawing strip may be a one-piece or a multi-piece drawing strip, the multi-piece drawing strip having a holder and at least one drawing tool which is interchangeably accommodated on the holder.

The drawing strip is advantageously mounted in the counterpressure plate in a removable manner. In this way, it can be rapidly removed in order to exchange the distance piece arranged underneath. In order to ensure the desired variability, distance pieces having different distance dimensions are provided and can be used optionally. An individual degree of deflection of the metal sheet is achieved with each distance piece.

A development of the invention provides for a pressure pin to be provided between the table and drawing strip, and for the pressure pin to be shorter than the distance between the table and the drawing strip during the drawing phase, the distance being reduced during the drawing phase, and the pressure pin being clamped in place between the table and drawing strip at the end of the drawing phase or at the beginning of the stop phase, as a result of which the pressure pin directs a pressure force into the movable drawing strip and the drawing strip is lifted from the distance piece serving as a limit stop for the drawing strip, as a result of which the drawing strip is displaced into the second deflection stage.

During the displacement of the drawing strip from the first deflection stage into the second deflection stage, the flow movement of the metal sheet in the flow path is retarded. The second deflection stage can cause inhibition of the drawing operation, this inhibition being so great that the metal sheet is stopped by the deflection and is only plastically formed by continuation of the deep-drawing operation.

Whether the deflection phase starts earlier or later depends on the lengthening of the pressure pin by the distance pieces. A long pressure pin will be clamped in place between the table and drawing strip sooner than a short pressure pin. In this way, the duration of the drawing phase and the beginning of the stop phase can be set, the relative movement of the pressure pin always starting at the same instant.

The end of the movement of the drawing strip, synonymous with the second deflection stage, is reached when the counterpressure plate has come into frictional contact with the table. This may be effected by direct or indirect contact.

The proposed method uses a drawing strip which can be used in a variable manner by combination with different distance pieces in order to individually adapt the degree of deflection of the metal sheet during the drawing phase. In this way, different bead depths can be achieved without using a separate drive which would have to control the bead depth.

The drive for the movement of the drawing strips from the first deflection stage into the second deflection stage is effected by frictional connection between the table, pressure pin and drawing strip. The stop phase begins from this point, during which the drawing strip is pushed further through the flow path of the metal sheet.

Furthermore, to achieve the object, a deep-drawing apparatus is proposed, wherein at least one interchangeable distance piece is provided for the purpose of setting the bead depth of the drawing bead acting during the drawing phase, and wherein the distance piece acts between the counterpressure plate and the drawing strip.

Since a drawing strip is possibly a long tool, a plurality of distance pieces which uniformly support the drawing strip may be arranged next to one another. In this way, flexure of the drawing strip is avoided.

Furthermore, the proposed deep-drawing apparatus is designed for permitting rapid changeover for the purpose of producing different drawn parts, the bead depth of which has to be set individually. Importance is attached to arranging the distance pieces, to be exchanged for the adjustment, in a simple and accessible manner between the removable drawing strip and the counterpressure plate.

In addition, with the inventive solution, importance is attached to the robustness of the apparatus. The proposed type of control of the movement of the drawing strip is very low-maintenance and easy to operate and, compared with the trouble-prone drawing strip control known from German Patent No. DE 199 53 751 A1, is especially operationally reliable.

A pressure pin is advantageously arranged offset from the distance piece between the drawing strip and the table, and a pressure force can be transmitted between the table and the drawing strip by the pressure pin. The pressure pin can be removed in a simple manner after removal of the drawing strip for the purpose of changing over to another drawn part to be produced. It can be exchanged for a pressure pin of another length.

The deep-drawing apparatus is expediently designed in such a way that the pressure pin is clamped in place between the table and drawing strip during the stop phase and is free of pressure during the drawing phase, since the distance between the table and drawing strip during the drawing phase is greater than the length of the pressure pin. With the combination according to the invention of a distance piece and pressure pin, the total travel of the drawing die when pressed onto the punch can be divided in a variable manner into a drawing phase and a stop phase.

The manipulation of the deep-drawing apparatus can be further improved if at least one distance element is provided which is arranged in addition to the pressure pin between the table and the drawing strip. The distance element is connected in series with the table, pressure pin and drawing strip and is favorably arranged in such a way that it is readily accessible and can easily be exchanged. In this way, if the stop phase is to be altered, exchange of the pressure pin can be dispensed with. As an alternative, the distance element is exchanged in order to vary the stop phase.

The distance element may be a distance piece having a fixed distance dimension. In this case, individual distance pieces having different distance dimensions are provided for different drawn parts made of different materials. Alternatively, an adjustable distance device which does not have to be exchanged may be provided, since the distance dimension of the distance device is variable. The distance device provided may be an eccentric or a pair of distance wedges which permit a variable distance dimension of the distance device by displacement relative to one another.

In a simpler manner, the pressure pin is mounted in the counterpressure plate such as to be axially movable, namely movable parallel to the press direction of the press.

An embodiment of a pressure pin has a radially projecting retaining collar at the end facing the drawing strip, the diameter of said retaining collar being larger than a bearing bore of the counterpressure plate, the pressure pin being guided rectilinearly in said bearing bore. In this way, the pressure pin is suspended in the counterpressure plate. The pressure pin can be moved from this position in the counterpressure plate in the direction of the drawing strip. This takes place when the bottom end of the pressure pin strikes the table; namely direct or indirect frictional connection relative to the table occurs.

A further improvement provides for at least one distance element to be arranged between the table and the drawing strip at both ends of the pressure pin.

The variability is increased by a plurality of distance elements which together with the pressure pin can be placed in an abutting relationship between the drawing strip and table. Thus, for example, distance pieces which have distance dimensions graduated in steps of 1 mm can be combined with other distance pieces which have distance dimensions graduated in steps of 0.5 mm. Of course, the graduation of distance pieces may also be substantially finer than steps of 0.5 mm and substantially coarser than steps of 1 mm.

The invention is shown by way of example below in the drawing and is described in more detail with reference to several schematic figures.

DETAILED DESCRIPTION OF THE PREFERRED EMBODIMENT

Figure 1:
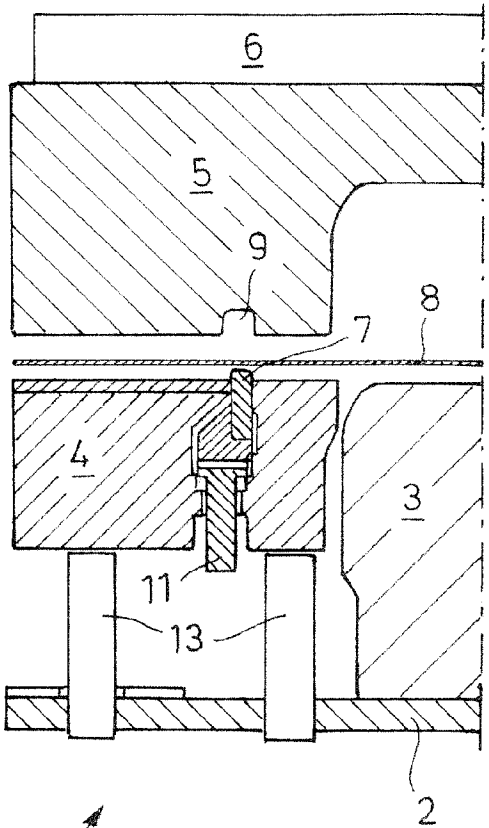
FIG. 1 shows a symmetrical half of a deep-drawing apparatus in section in the open state.
Figure 2:
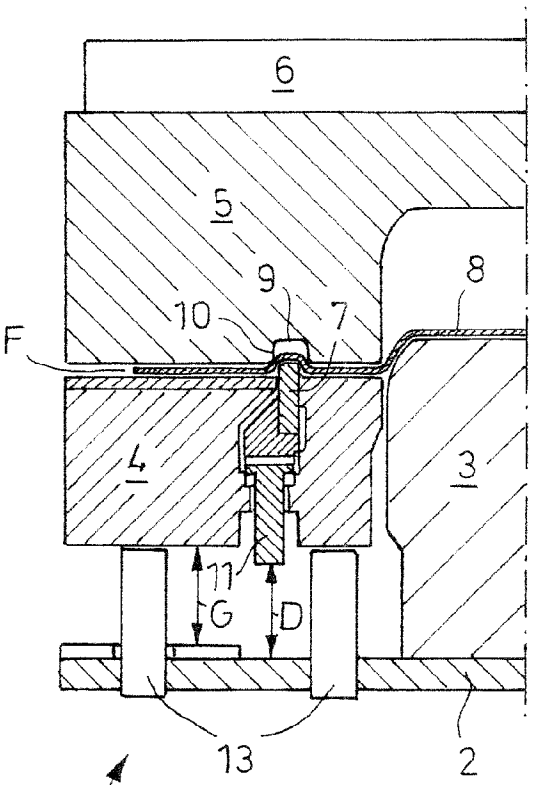
FIG. 2 shows the deep-drawing apparatus according to FIG. 1 during a drawing phase with the drawing strip pushed transversely through the flow path of a metal sheet.
Figure 3:
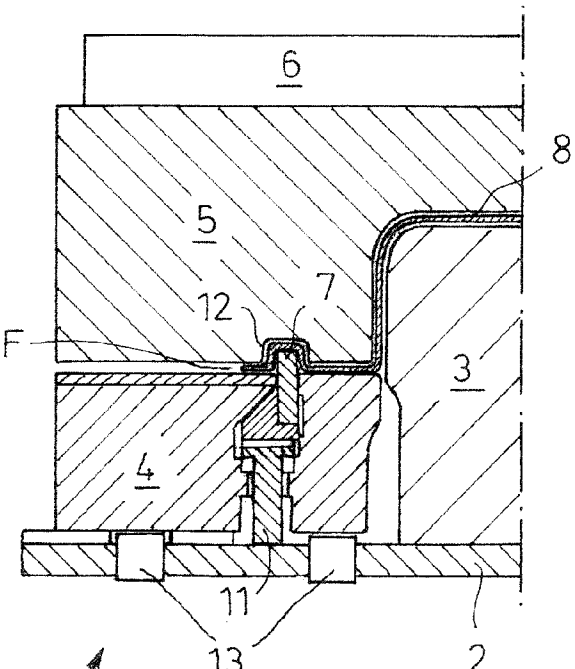
FIG. 3 shows the deep-drawing apparatus according to FIG. 1 during a stop phase at the end of the deep-drawing operation.

A deep-drawing operation in a plurality of steps is shown in FIGS. 1 to 3. The sectional illustrations each show a symmetrical half of a deep-drawing apparatus 1. The deep-drawing apparatus 1 has a table 2. A drawing punch 3 is disposed on the table 2, and provided next to the drawing punch 3 on the table 2 is a counterpressure plate 4, which can produce a counterholding force perpendicularly away from the table 2. The deep-drawing apparatus 1 has a drawing die 5 above the drawing punch 3 and the counterpressure plate 4. The drawing die 5 is arranged on a press 6, with which a pressure is produced in the direction of the table 2. Arranged in the counterpressure plate 4 is a drawing strip 7 which can be moved transversely to the plane of a metal sheet 8 or transversely to a flow path F of the metal sheet 8. Designated as flow path F is the path which, as shown in FIG. 2 between the drawing die 5 and the counterpressure plate 4, runs orthogonally to the longitudinal extent of the drawing strip 7 in the direction of the drawing punch 3. The metal sheet 8 slips through this drawing gap designated as flow path F.

The deep-drawing apparatus 1 is shown in the open state in FIG. 1. The drawing die 5 is arranged at a distance above the drawing punch 3 and the counterpressure plate 4, such that a metal sheet 8 can be inserted into the deep-drawing apparatus 1. The metal sheet 8 rests first of all only on the drawing strip 7. The drawing strip 7 projects from the counterpressure plate 4 to a certain extent. This extent can be set individually.

Shown in FIG. 2 is a drawing phase of the forming during which the metal sheet 8 is drawn through the flow path F which has formed between the drawing die 5 and the counterpressure plate 4. For the forming of the metal sheet 8, the drawing die 5 is moved in the direction of the table 2 by the force of the press 6. In the process, the counterpressure plate 4 is pressed in the direction of the drawing die 5 and transmits a counterholding force to the metal sheet 8. The drawing die 5 and the counterpressure plate 4 approach the table 2 with a synchronous movement, while the metal sheet 8 is clamped in place.

The drawing strip 7 projects into a drawing groove 9 provided in the drawing die 5 and in this way deflects the flow path F of the metal sheet 8. The deflection, shown in FIG. 2, of the metal sheet 8 by the drawing strip 7 is bead-shaped and is to be designated as drawing bead 10 within the scope of the invention. The bead depth of the drawing bead 10 or, in other words, the degree of deflection remains constant during the drawing phase. The metal sheet 8 is drawn continuously through the drawing bead 10. The end of the metal sheet 8 moves closer and closer to the drawing strip 7. The counterpressure plate 4 and the drawing die 5 come nearer and nearer to the table 2. The deep-drawing apparatus 1 is constructed in such a way that, during the lowering of the counterpressure plate 4, a pressure pin 11 first comes into contact with the table 2 and then with the drawing strip 7. Starting from this instant, the drawing strip 7, in order to continue the deep-drawing operation, is pushed deeper into the drawing groove 9 of the drawing die 5, because the pressure pin 11 is clamped in place between table 2 and drawing strip 7. In other words, the drawing strip 7, during the drawing phase, is lowered synchronously with the counterpressure plate 4 and the drawing die 5. The bead depth of the drawing bead 10 remains constant. As soon as the pressure pin 11 has come into contact with the table 2 and the drawing strip 7, the drawing strip 7 cannot be lowered any further. Nonetheless, if the drawing die 5 and the counterpressure plate 4 are lowered further, the bead depth increases and a bead is formed, which is designated as stop bead 12 within the scope of the invention. The deep-drawing operation is complete at the latest when the drawing punch 3 is in positive-locking connection with the metal sheet 8 and the drawing die 5 or when the counterpressure plate 4 comes into contact with the table 2. For the two distance dimensions depicted in FIG. 2: $D<G$. The distance D of the pressure pin 11 from the table 2 is less than the distance G of the counterpressure plate 4 from the table 2.

The end of the stop phase and the end of the deep-drawing operation are shown in FIG. 3. In this position, both the drawing punch 3 and the drawing die 5 are in contact with the metal sheet 8. The drawing strip 7 is displaced by its maximum travel into the drawing groove 9 of the drawing die 5.

Figure 10:
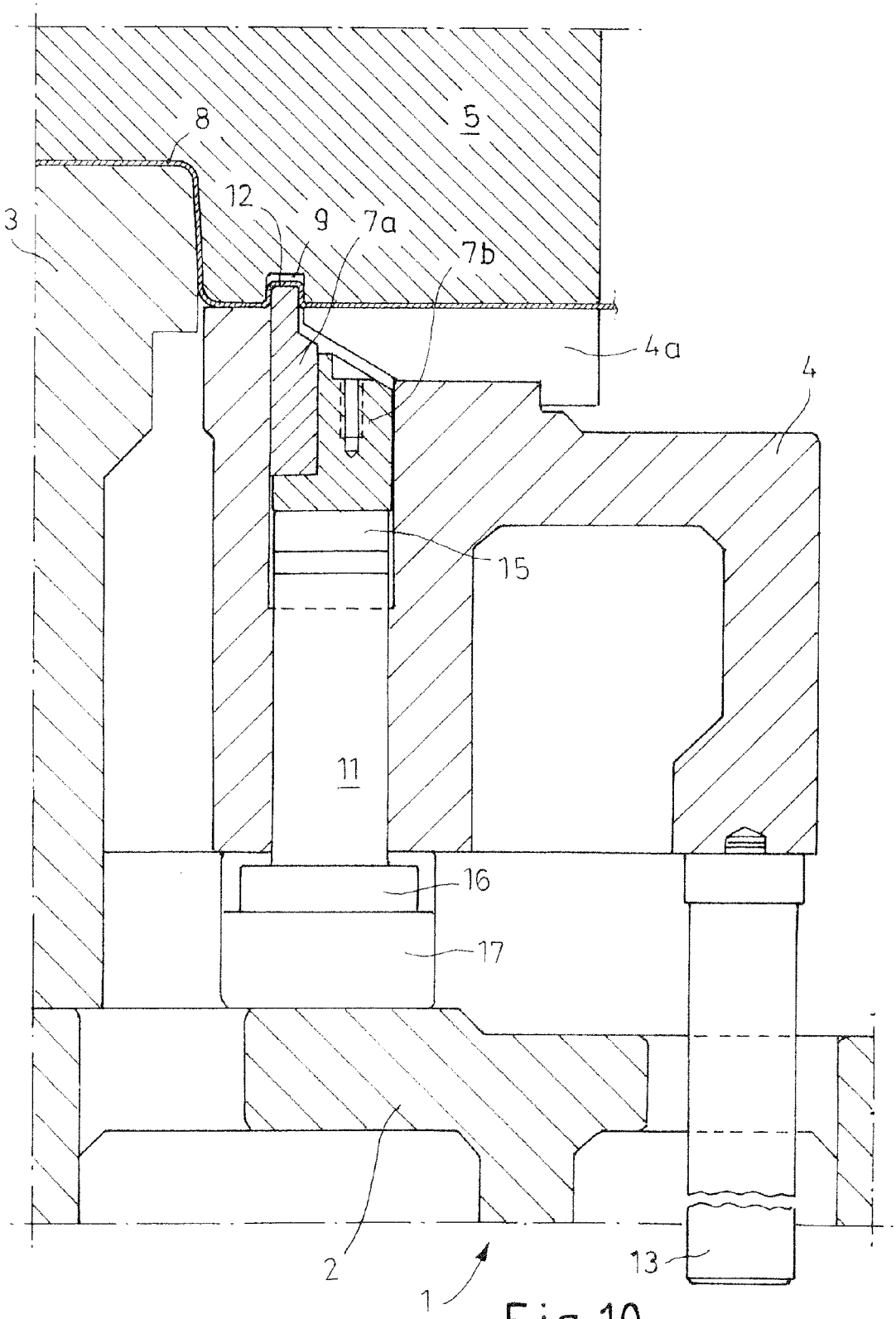
FIG. 10 shows a detailed sectional illustration of the deep-drawing apparatus according to FIGS. 8 and 9 in the stage of a stop phase at the end of the deep-drawing operation.
Figure 11:
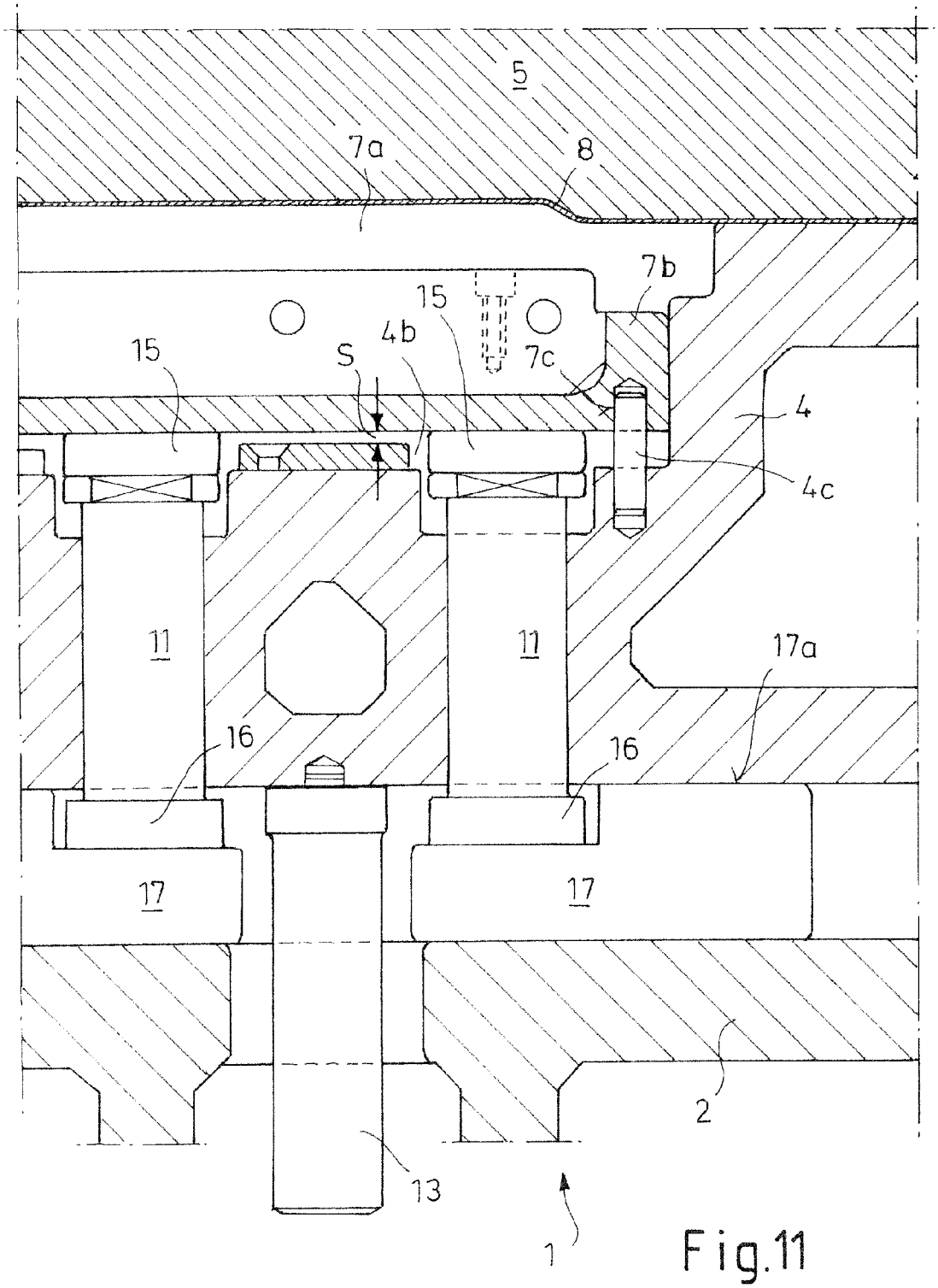
FIG. 11 shows a side view of the deep-drawing apparatus according to FIG. 10.
Figure 12:
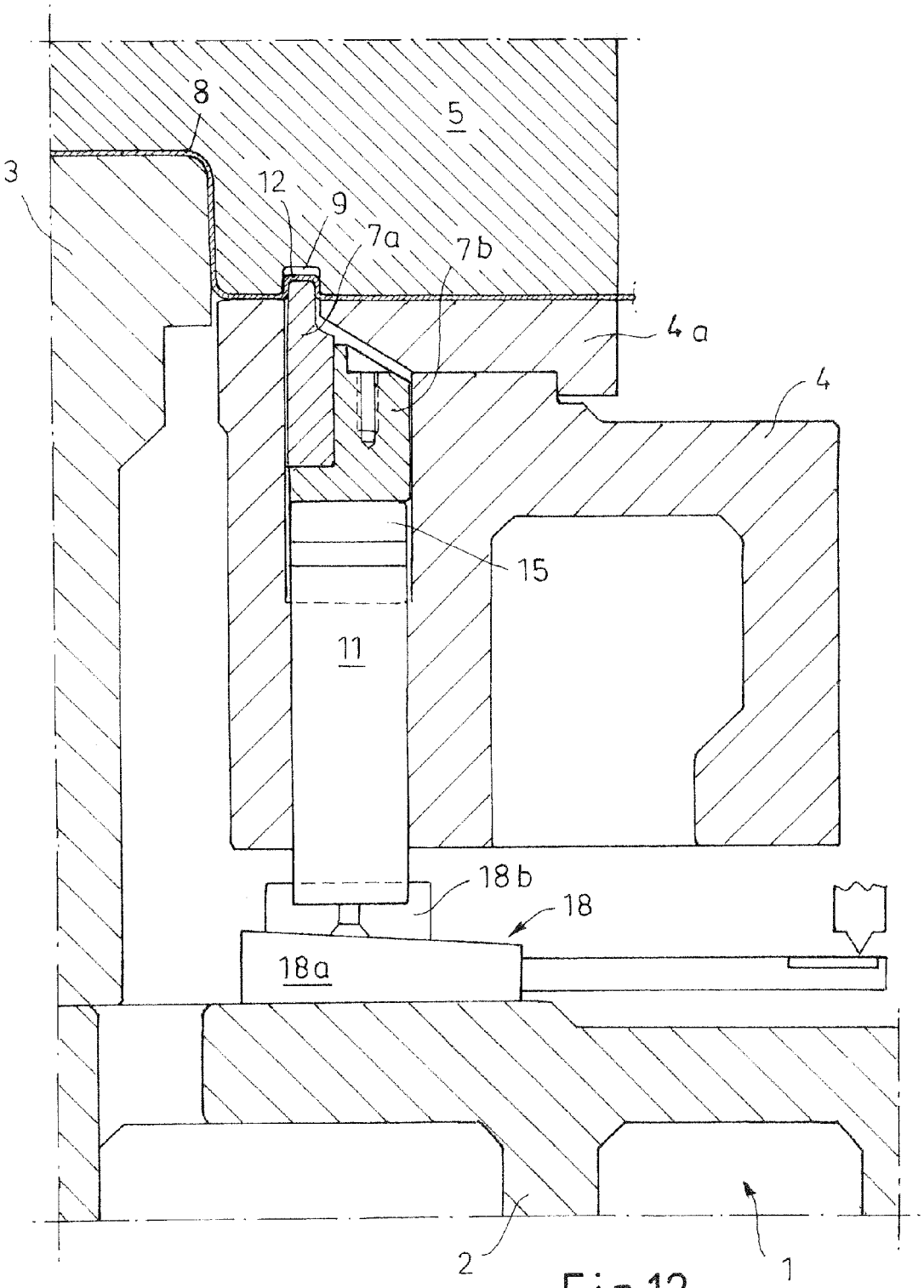
FIG. 12 shows a detailed cross section through a deep-drawing apparatus having a distance element which can be adjusted from outside the tool and is connected in series with a pressure pin.
Figure 13:
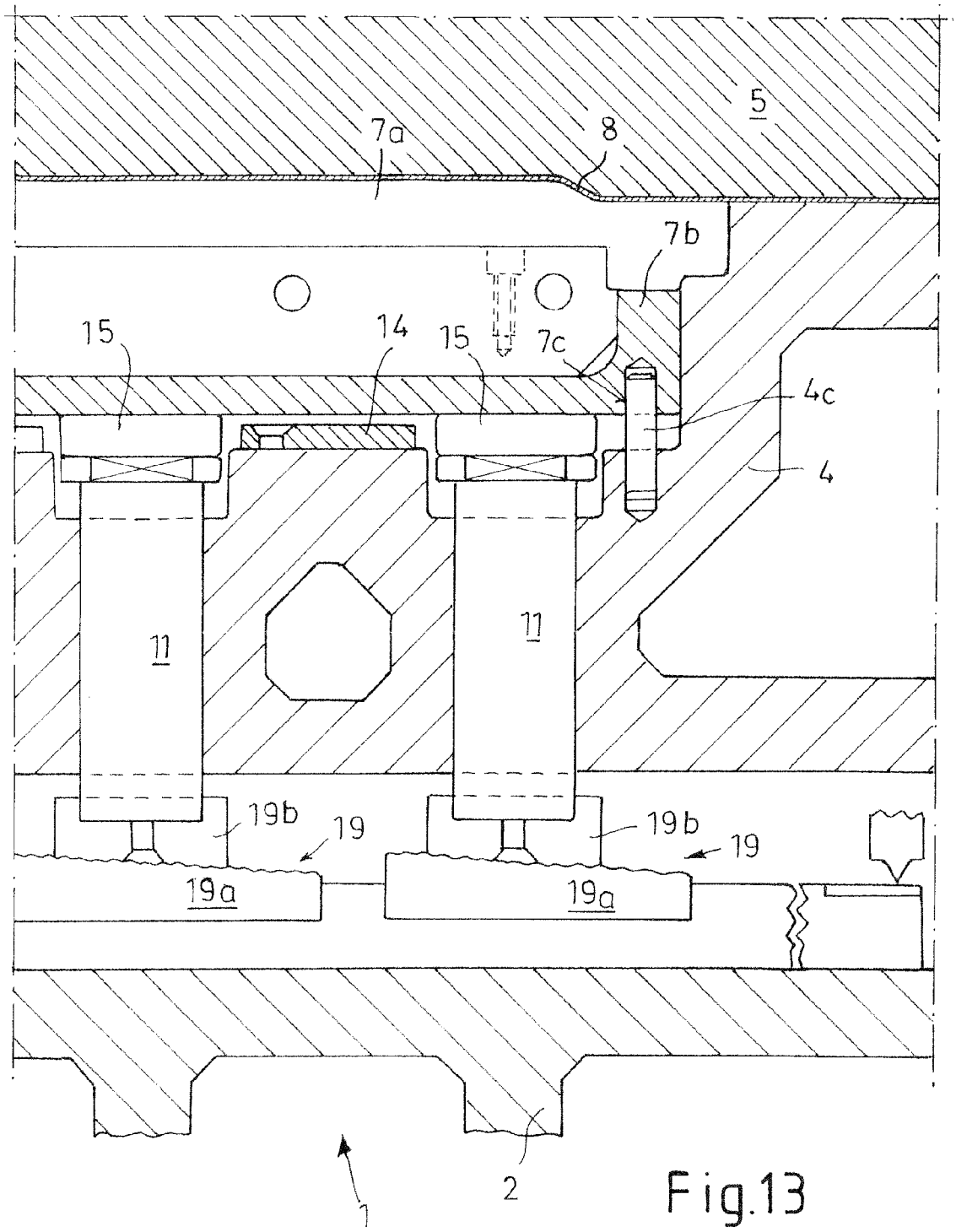
FIG. 13 shows a side view of the deep-drawing apparatus with a development of the distance element according to FIG. 12.
Figure 14:
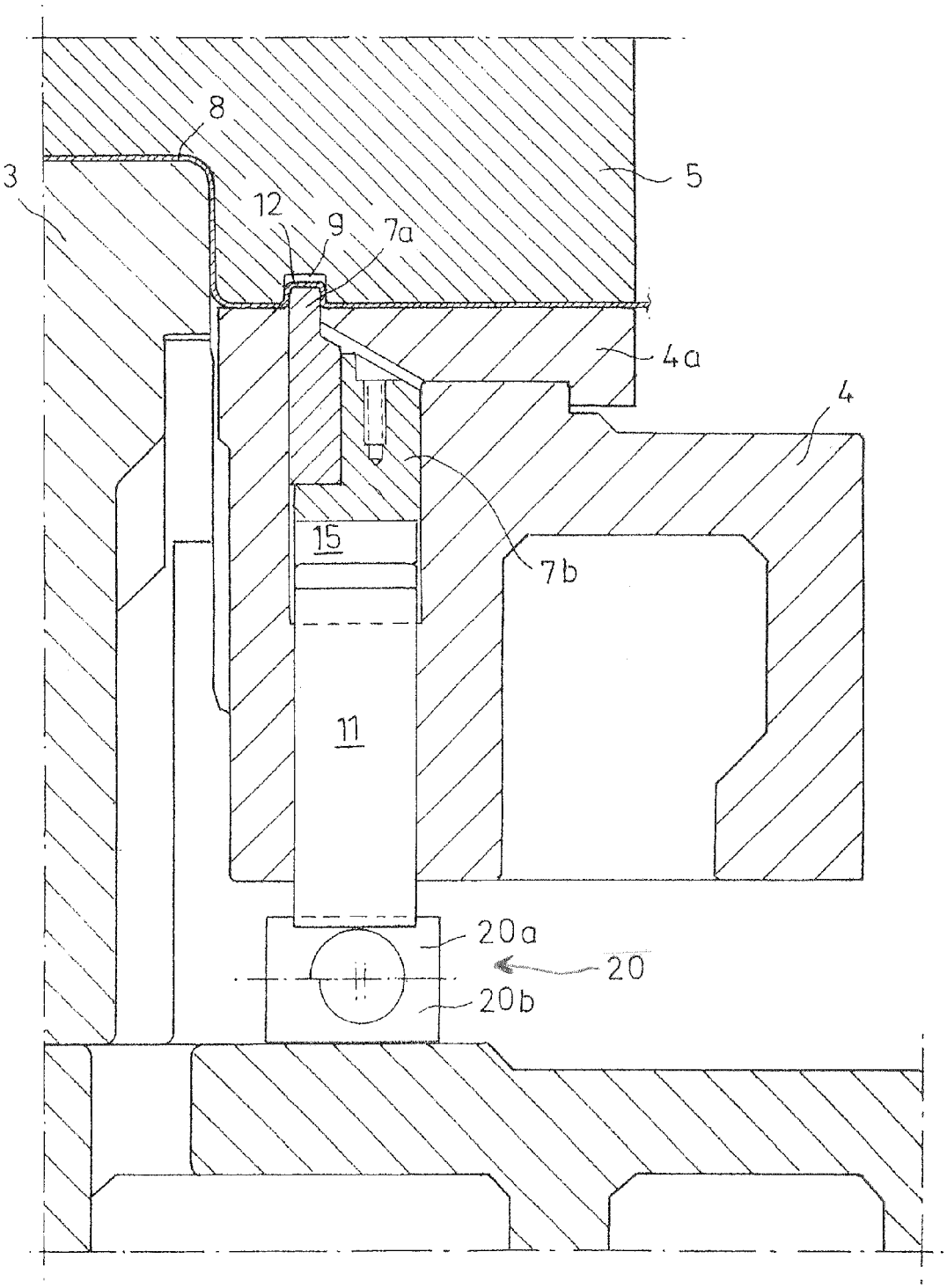
FIG. 14 shows a detailed cross section of a deep-drawing apparatus having an adjustable distance element which is connected in series with a pressure pin and has an eccentric.

Enlarged details of two embodiments of a deep-drawing apparatus 1 are shown in FIGS. 4 to 11. Further exemplary embodiments are shown in FIGS. 12 to 14. All the exemplary embodiments show a table 2, a counterpressure plate 4, a drawing strip 7 and a pressure pin 11.

A drawing punch 3 and a drawing die 5 can be seen only in FIGS. 4, 6, 8, 10, 12 and 14, whereas they are concealed in the other figures.

The counterpressure plate 4 has a removable plate part 4*a*. The latter can easily be detached. If the plate part 4*a* is removed, the drawing strip 7 can be removed and exchanged. In this way, the deep-drawing apparatus 1 can be retrofitted in an especially simple manner if other drawing parameters are to be set or the wear compensated for.

The drawing strip 7 has a drawing strip tool 7*a* and a drawing strip holder 7*b* for the drawing strip tool 7*a*. The drawing strip tool 7*a* is releasably connected to the drawing strip holder 7*b*. The drawing strip holder 7*b* is displaceably accommodated in a recess 4*b* of the counterpressure plate 4, namely such as to be displaceable parallel to the direction of movement of the drawing die 5. Provided in the recess 4*b* is a guide pin 4*c*, which forms a sliding fit with a guide bore 7*c* of the drawing strip holder 7*b*.

Attached to that side of the counterpressure plate 4 which faces the table 2 are quills 13 which introduce a counterholding force into the counterpressure plate 4. The counterholding force can be produced, for example, hydraulically.

Figure 4:
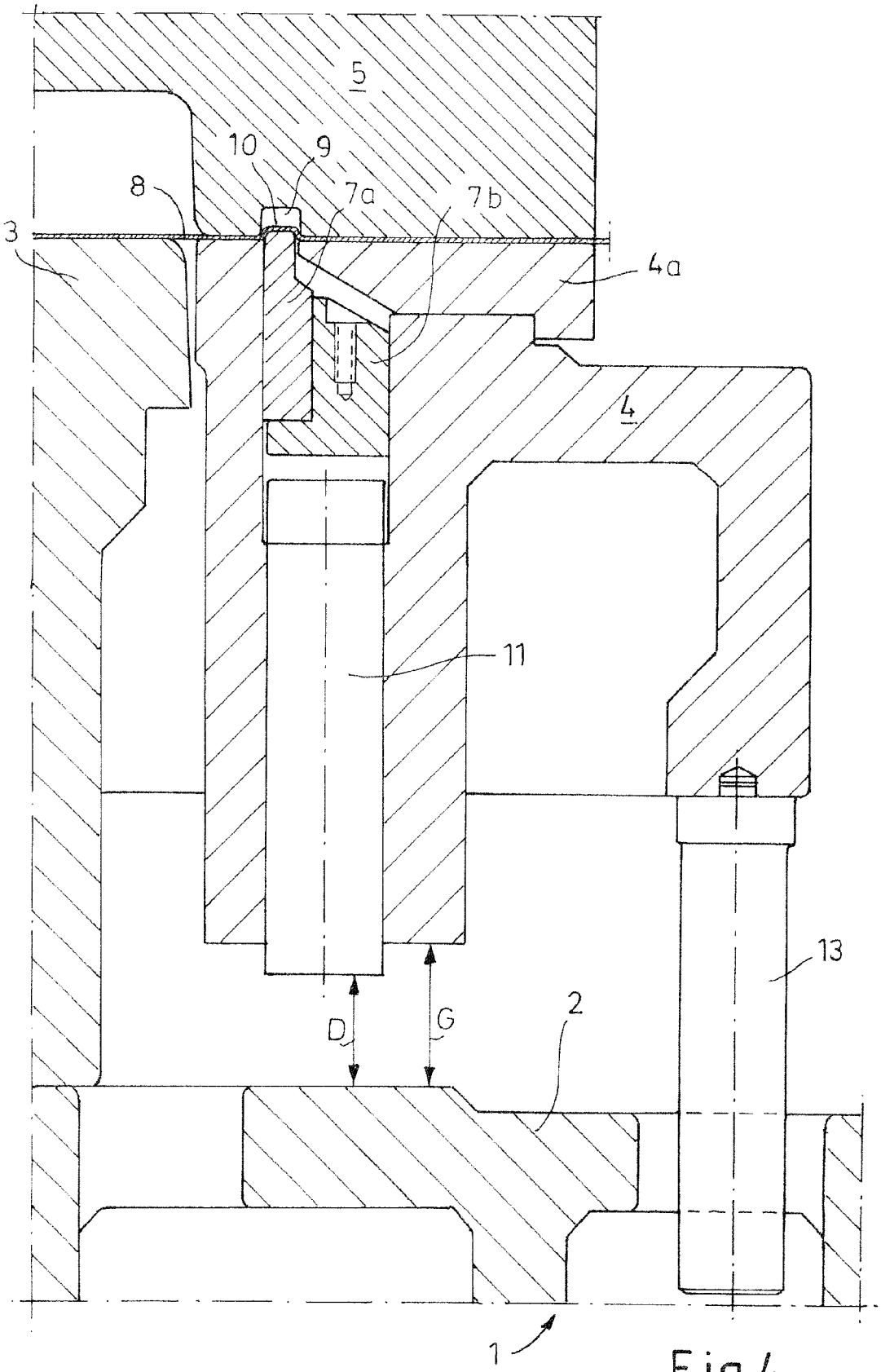
FIG. 4 shows an enlarged illustration of a deep-drawing apparatus having a pressure pin arranged between a drawing strip and a table, the whole thing as an enlarged detail.
Figure 5:
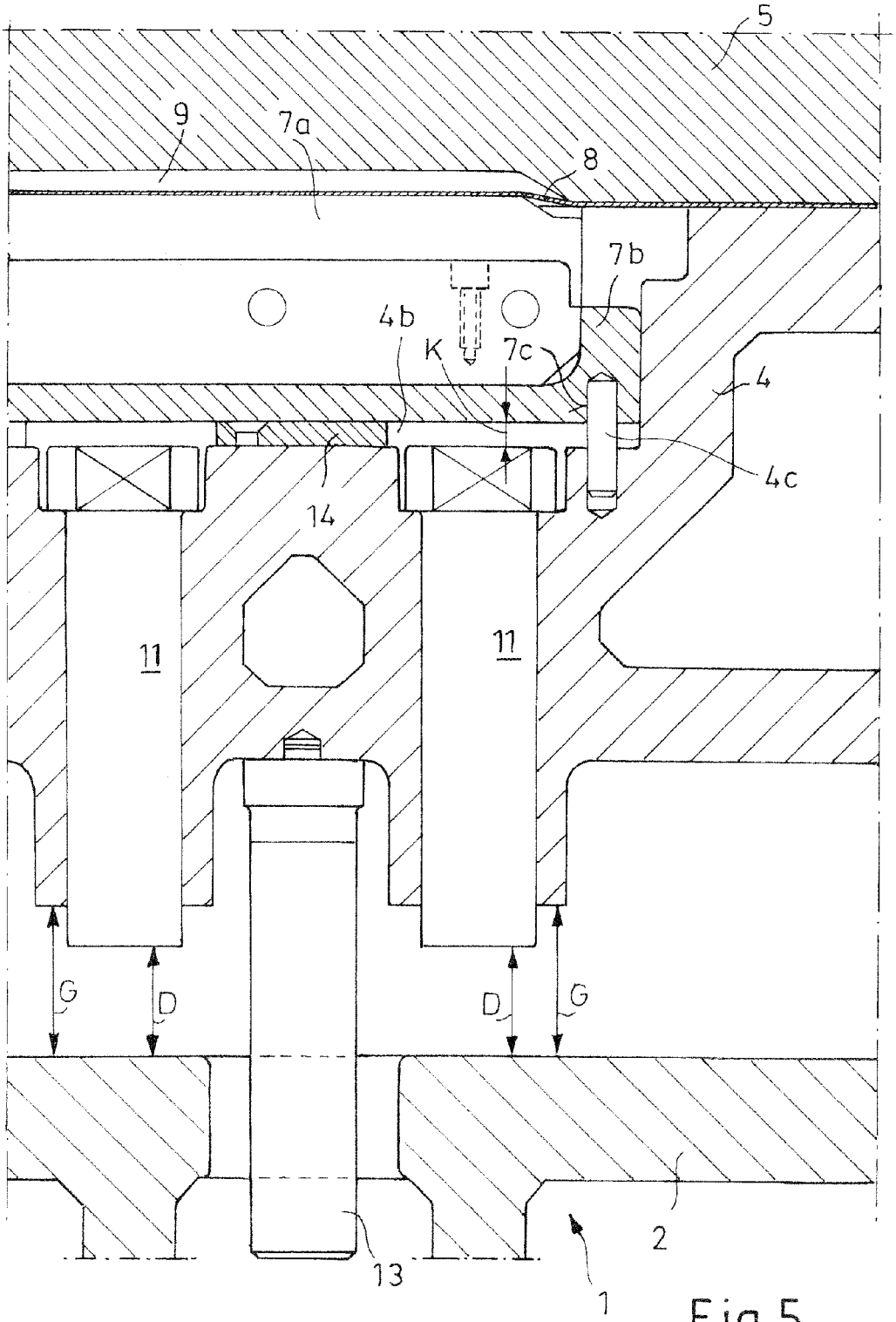
FIG. 5 shows a side view of the deep-drawing apparatus according to FIG. 4.

An embodiment of a deep-drawing apparatus 1 is shown in more detail in FIGS. 4 to 7. Said deep-drawing apparatus 1 has a pressure pin 11 which is in direct contact with both the drawing strip 7 and the table 2 during the stop phase. During operation, a head end of the pressure pin 11 comes into contact with the drawing strip 7. A foot end of the pressure pin 11 rests on the table 2 when the stop phase of the deep-drawing operation begins. FIGS. 4 and 5 belong together. FIG. 5 shows the same deep-drawing apparatus 1 and the same stage of the deep-drawing operation. In both illustrations, the pressure pin 11 in each case is at the same distance D from the table 2.

In order to set the depth to which the drawing strip 7 is pushed through the flow path F of the metal sheet 8 during the initial drawing phase, a distance piece 14 is provided as shown in FIG. 5. The bead depth of the drawing bead 10 can be varied by changing the thickness of the distance piece 14. Distance pieces may of course also be stacked in order to vary the bead thickness by changing the overall thickness of a stack. The distance piece 14 is arranged in the recess 4*b* of the counterpressure plate 4. When the drawing strip 7 is inserted into the recess 4*b*, it cannot be lowered right down to the bottom of the recess 4*b*, because the distance piece 14 forms a limit stop. Depending on the thickness of the distance piece 14, the drawing strip 7 projects beyond the level of the surface of the counterpressure plate 4.

Figure 6:
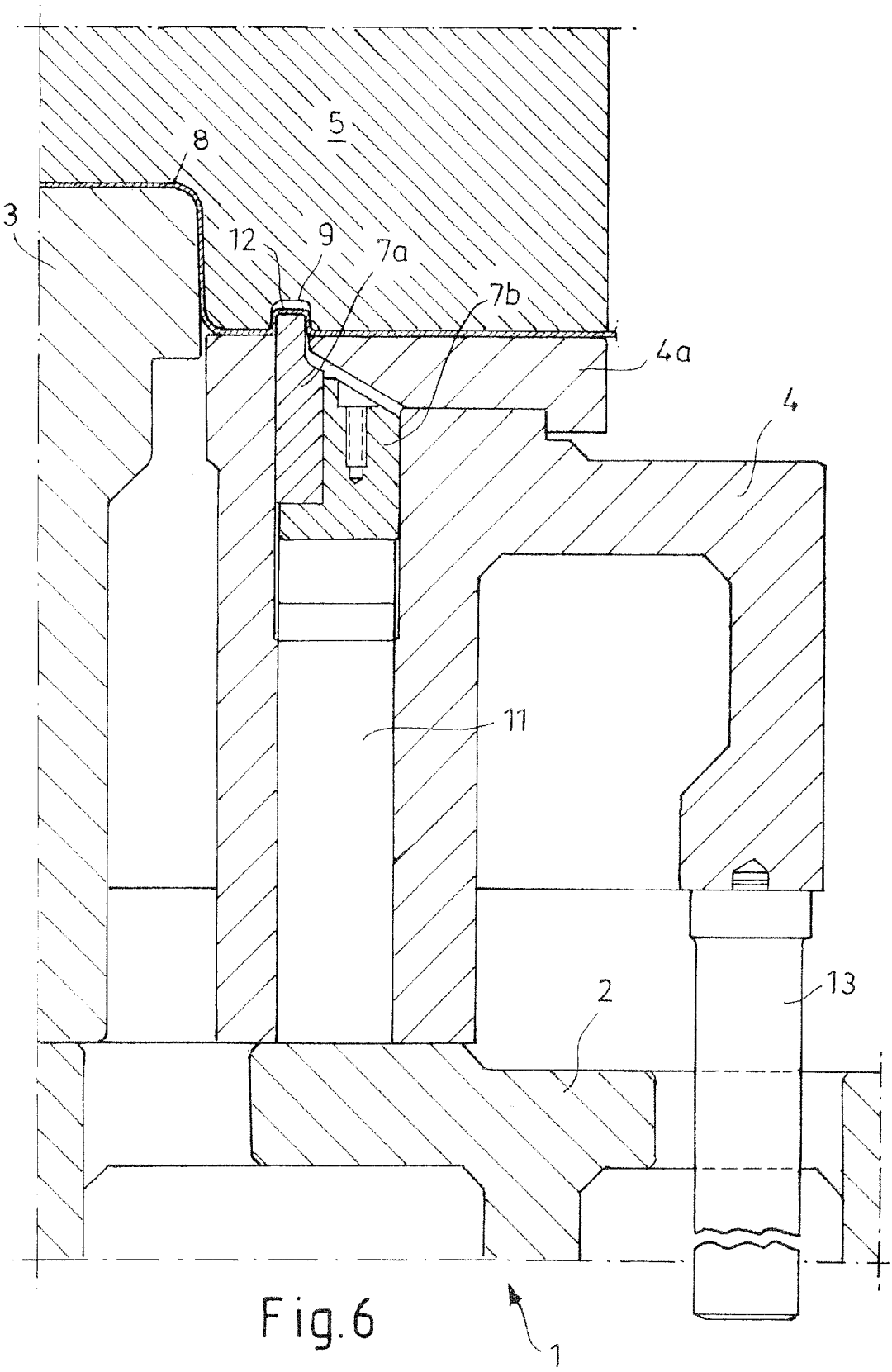
FIG. 6 shows the deep-drawing apparatus according to FIG. 4 during a stop phase at the end of the deep-drawing operation, with a pressure pin clamped in place between the drawing strip and table.
Figure 7:
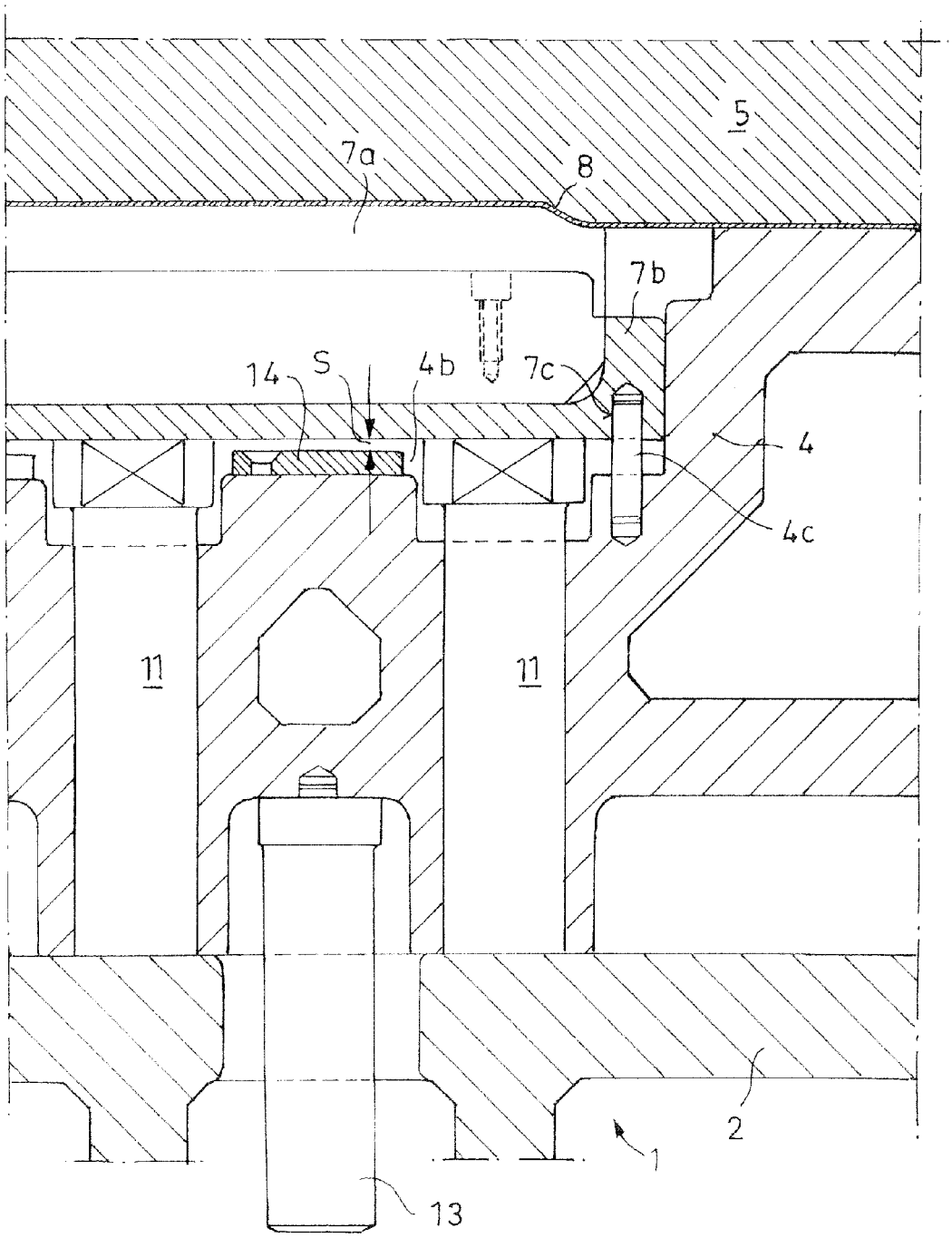
FIG. 7 shows a side view of the deep-drawing apparatus in the position according to FIG. 6.

The same deep-drawing apparatus 1 as in FIGS. 4 and 5 is shown once again in FIGS. 6 and 7. The deep-drawing operation is complete in this stage.

FIG. 6 shows a detail of the deep-drawing apparatus 1. The drawing strip 7 can be seen in cross section. FIG. 7 shows the same stage of the deep-drawing operation, but as a side view. The metal sheet 8 is drawn completely around the drawing punch 3. The previous distance D of the pressure pin 11 from the table 2 has shrunk to zero in FIG. 6. The pressure pin 11 has first come into contact with the table 2. At the instant of this contact, there is still a distance between the pressure pin 11 and the drawing strip 7. By continuation of the deep-drawing operation, the counterpressure plate 4 and with it the drawing strip 7 are lowered further until the drawing strip 7 strikes the pressure pin 11. This moment is the beginning of the stop phase of the drawing operation. During continuation of the deep-drawing operation, the counterpressure plate 4 is lowered further until the distance dimension G between the counterpressure plate 4 and the table 2 has also shrunk to zero, as can be seen in FIG. 7. During the lowering of the counterpressure plate 4, the drawing strip 7 has been pushed deeper into the drawing groove 9 of the drawing die 5.

The associated FIG. 7 shows a side view of the deep-drawing apparatus 1. The deep-drawing operation is at the same stage as in FIG. 6. The distance piece 14 has been lowered together with the counterpressure plate 4 and the drawing die 5. A gap S has arisen between the distance piece 14 and the drawing strip 7, because the drawing strip 7 cannot be lowered further. The drawing strip 7 has been prevented from lowering further since the moment at which it rests on the pressure pin 11. In other words: the pressure pin 11, when it stands on the table 2, forms a limit stop for the drawing strip 7. As soon as the drawing strip 7 comes into contact with this limit stop, the drawing phase is complete and the stop phase of the deep-drawing operation begins. The size of the gap S between the distance piece 14 and drawing strip 7 at the end of the stop phase corresponds to the distance by which the drawing strip 7 is moved into the drawing groove 9 of the drawing die 5 from the beginning of the stop phase to the end of the stop phase.

Two pressure pins 11 are in each case shown next to one another in the details depicted in FIGS. 5 and 7. Depending on the size of the drawing strip 7, a multiplicity of pressure pins 11 can be provided next to one another in order to uniformly support the drawing strip 7. The same applies to the distance pieces 14, of which a multiplicity can also be distributed next to one another over the length of the drawing strip 7 in order to support the latter and prevent flexure.

If, in the deep-drawing apparatus 1 according to FIGS. 4 to 7, the bead depth of the initial drawing bead 10 is to be larger than in the example shown, the distance piece 14 which is shown in FIGS. 5 and 7 must be exchanged for a distance piece 14 of another thickness.

If a drawn part which necessitates an earlier or later beginning of the stop phase is to be produced, this can be set. The beginning of the stop phase of the drawing operation is altered in the deep-drawing apparatus 1 according to FIGS. 4 to 7 by the existing pressure pin 11 being exchanged for a shorter or longer pressure pin 11.

Since the stop phase always begins when the pressure pin 11 has come into contact with both the table 2 and the drawing strip 7, the distance D must first be reduced to zero in the course of the drawing operation and in addition the distance K between pressure pin 11 and drawing strip 7 must have become zero. An earlier beginning of the stop phase can thus be achieved if at least one of the distances K or D is reduced. This can be done, for example, by a longer pressure pin 11 being used. The pressure pin 11 can be lengthened with the aim of reducing the distance K, or the distance K remains and the pressure pin 11 is lengthened at the opposite end, with the aim of reducing the distance D. The pressure pin 11 can of course also be lengthened at both ends.

Figure 8:
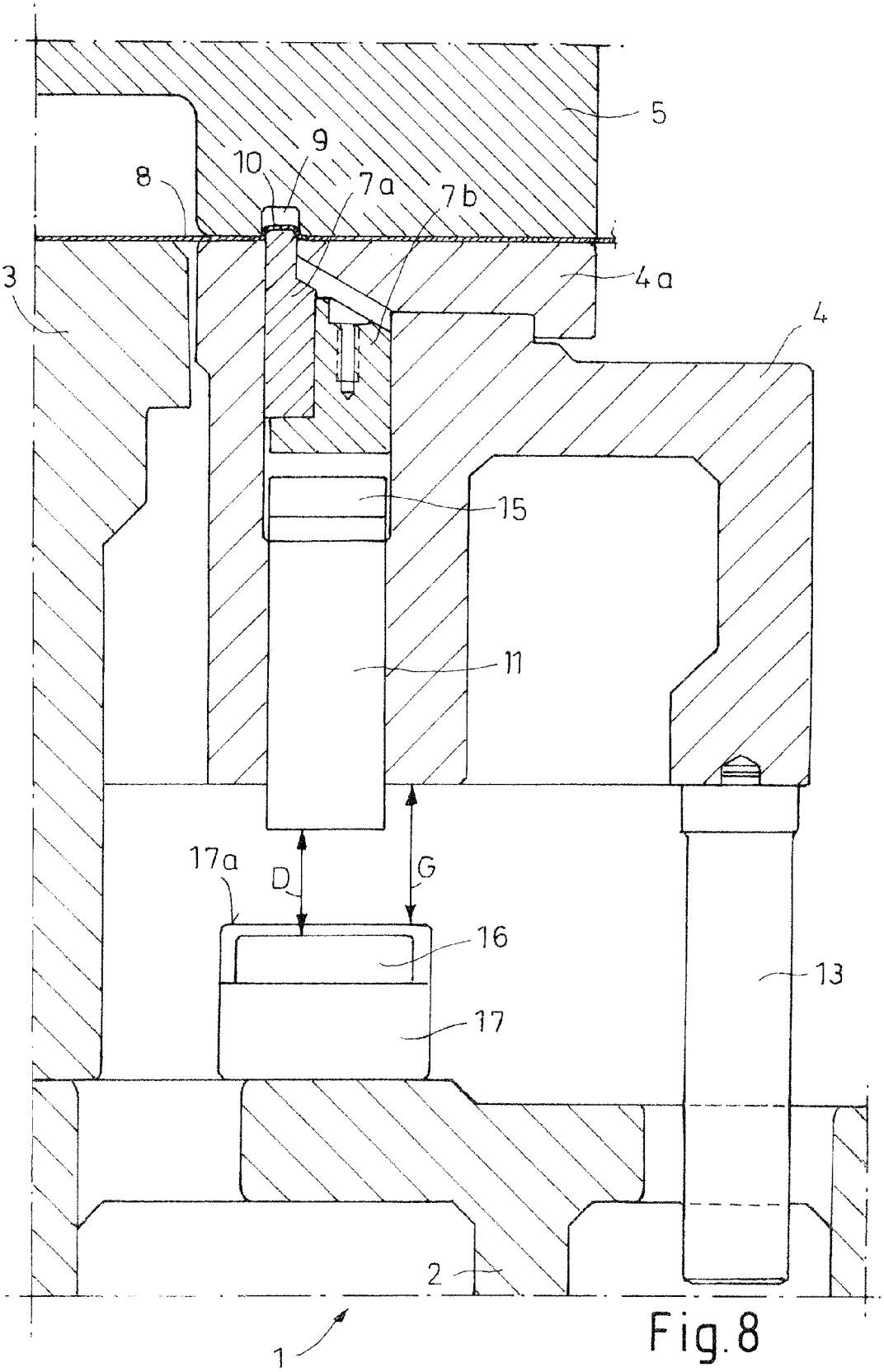
FIG. 8 shows an enlarged detail of an alternative embodiment of a deep-drawing apparatus in the stage of a drawing phase according to FIG. 2.
Figure 9:
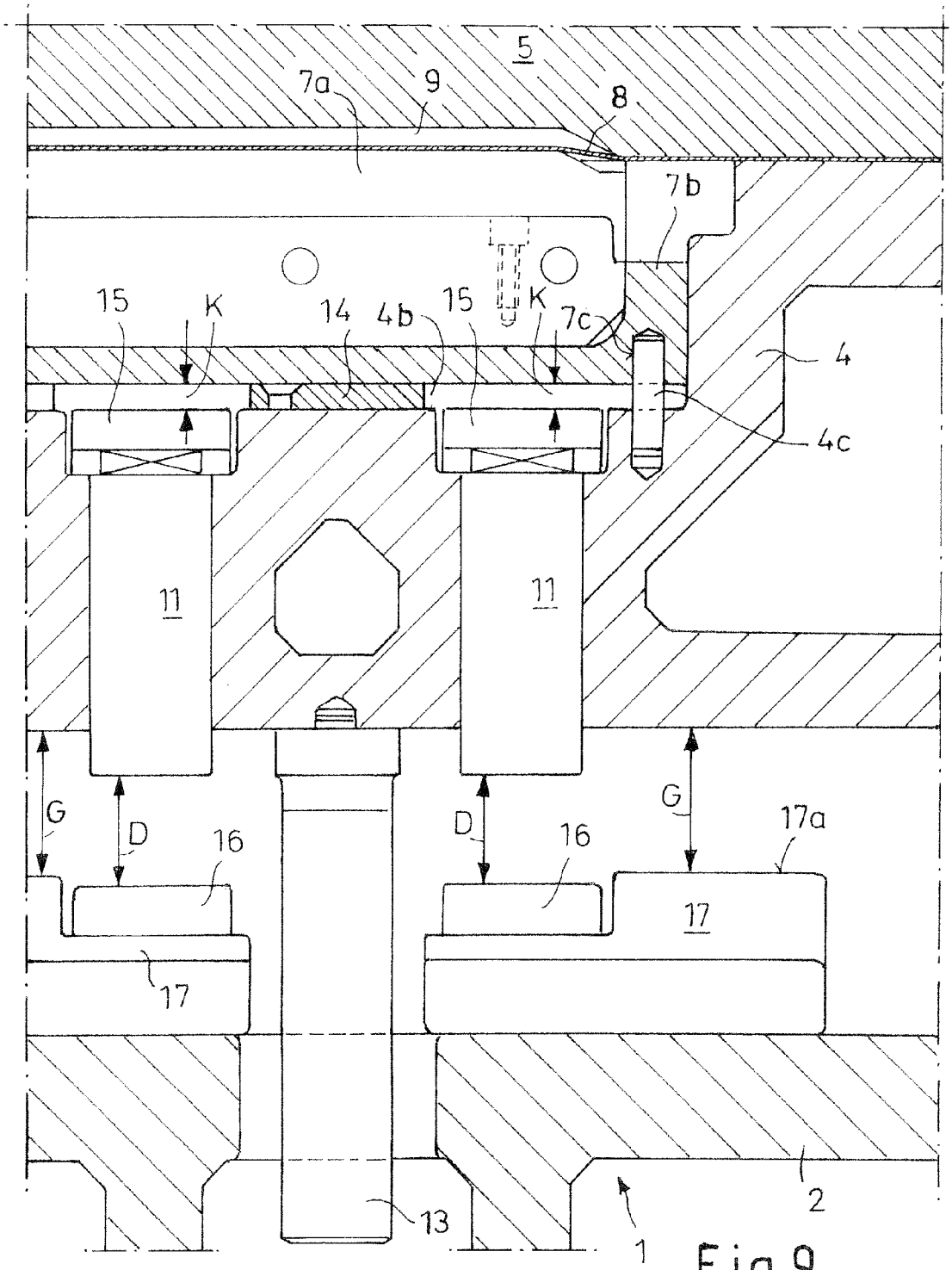
FIG. 9 shows a side view of the deep-drawing apparatus according to FIG. 8.

On the other hand, the stop phase can be altered by an additional distance element being placed with the pressure pin 11 in series between the drawing strip 7 and the table 2. An exemplary embodiment thereof is described with reference to FIGS. 8 to 11. FIGS. 8 to 11 each show the same deep-drawing apparatus 1. FIGS. 8 and 9 belong together, because they show the deep-drawing apparatus 1 from two perspectives, but in the same stage of the deep-drawing operation. The drawing strip 7 can be seen in FIG. 8, which has deflected the flow path F of the metal sheet 8 by the metal sheet 8 having been pressed into a drawing groove 9 of the drawing die 5. The drawing punch 3 has still not effected any forming of the metal sheet 8. The pressure pin 11 of the deep-drawing apparatus 1 is designed to be shorter than the pressure pin 11 according to FIGS. 4 to 7; for this purpose, in addition to the pressure pin 11, a distance piece 15 is provided between pressure pin 11 and drawing strip 7, and an additional distance piece 16 is also arranged between pressure pin 11 and table 2. The latter distance piece 16 is arranged on a bracket which is disposed on the table 2. In this design, the distance piece 16 lying on the bracket 17 forms a limit stop for the pressure pin 11, and the bracket 17 has a bearing surface 17*a*, which lies higher than the distance piece 16, and forms a table-side limit stop for the counterpressure plate 4. When the drawing die 5 and the counterpressure plate 4 are lowered in the direction of the table 2 during the deep-drawing operation, first of all the distance D between pressure pin 11 and distance piece 16 is reduced to zero. The depth of the drawing bead 10 remains constant during this phase. During further lowering of the drawing die 5, the distance K between the distance piece 15, which rests on the pressure pin 11, and the drawing strip 7, now becomes smaller. When the distance K has become zero and the deep-drawing operation is continued, the stop phase begins, during which the drawing strip 7 is pushed deeper into the drawing groove 9 of the drawing die 5 and the deflection of the metal sheet 8 is increased. At the same time, a gap S, which is depicted in FIG. 11, will form between the drawing strip 7 and the distance piece 14.

FIG. 10 shows the end of the deep-drawing operation. The drawing punch 3 has completely formed the metal sheet 8. The drawing strip 7 has been displaced deeper into the drawing groove 9 of the drawing die 5 than during the drawing phase. It has brought about greater deflection of the flow path F of the metal sheet 8 during the closing phase of the deep-drawing operation and has inhibited the flow movement or slipping movement of the metal sheet 8 in the flow path F.

The same stage of the deep-drawing operation is shown in FIG. 11. The deep-drawing operation is ended by the counterpressure plate 4 running against the bearing surface 17*a* of the bracket 17. The size of the gap S between the distance piece 14 and the drawing strip 7 corresponds to the distance by which the drawing strip 7 is moved deeper into the drawing groove 9 of the drawing die 5 during the stop phase.

Further exemplary embodiments of deep-drawing apparatuses 1 are shown in FIGS. 12 to 14. They show adjustable distance devices. The same features are provided therein with the same designations as in the previous exemplary embodiments.

FIG. 12 is an example of a deep-drawing apparatus 1 which has a distance device 18 which is connected in series with a pressure pin 11 and whose distance dimension is adjustable. Two distance wedges 18*a* and 18*b* offset from one another are provided, of which one distance wedge 18*a* is displaceable in the wedge direction. The overall thickness of the wedge pair 18*a*/18*b* is varied in this way. The distance wedge 18*b* is attached to one end of the pressure pin 11. At the beginning of the deep-drawing operation, this distance wedge 18*b* is at a distance from the other distance wedge 18*a*. When the deep-drawing operation advances, both distance wedges 18*a* and 18*b* strike one another, as shown in FIG. 12. The stop phase begins as soon as a frictional connection is produced between the table 2 and the drawing strip 7. The instant at which the distance wedges 18*a* and 18*b* strike can be varied in an infinitely adjustable manner by the adjustability of the distance wedges 18*a* and 18*b*.

FIG. 13 shows an exemplary embodiment of an adjustable distance device 19 in which a pair of distance blocks 19*a* and 19*b* which are of stepped design are provided. One distance block 19*b* is attached to the pressure pin 11. The associated distance block 19*a* is arranged on the table 2. Due to its incremental adjustability, the exemplary embodiment according to FIG. 13 avoids transverse forces on the pressure pin 11.

In FIG. 14, a distance device 20 which has an eccentric element 20*a* is arranged between pressure pin 11 and table 2. The eccentric element 20*a* is rotatably accommodated in a bearing block 20*b*. The instant at which the pressure pin 11 forms a frictional connection with the table 2 during the deep-drawing operation can be varied by rotating the eccentric element 20*a*.

What is claimed is:

1. A method for deep drawing a metal sheet including a press, a table, a drawing punch, a drawing die and a counterpressure plate interacting with the drawing die to form a flow path for the metal sheet, the method comprising a first deflection phase wherein at least one drawing strip movable relative to the counterpressure plate is pushed transversely through the flow path of the metal sheet in order to deflect the metal sheet during a drawing phase;

a second deflection phase wherein the drawing strip extends further transversely through the flow path and increases the degree of deflection of the metal sheet to inhibit the flow of the metal sheet during the second deflection stage, and wherein the metal sheet is essentially plastically formed at the end of the deep-drawing operation, wherein the degree of deflection required during the first deflection phase is set by means of an interchangeable distance piece which is arranged between the counterpressure plate and the drawing strip and serves as a limit stop; and providing a pressure pin between the table and the drawing strip, and wherein the pressure pin is shorter than the distance between the table and the drawing strip during the drawing phase, the distance being reduced during the drawing phase, and the pressure pin being clamped in place between the table and the drawing strip at the end of the drawing phase whereby the pressure pin exerts a force on the drawing strip and the drawing strip is lifted from the distance piece serving as a limit stop for the drawing strip, such that the drawing strip is in the second deflection phase.

2. A deep-drawing apparatus for metal sheets, comprising:

a table and a press, said press operative to move in a reciprocal manner between a first position and a second position;

a drawing punch, a drawing die, a counterpressure plate located between said table and said press;

a plurality of drawing strips having an upper surface mounted in the counterpressure plate for movement in the direction of the press;

drawing grooves having a groove base in the drawing die and into which the drawing strips can be incrementally moved to maintain a gap between said upper surface of said drawing strip and said groove base of said drawing grooves; and said drawing strips operative to move between a drawing bead position wherein the drawing strips cooperate with the drawing grooves to create a drawing bead in the metal sheet and at least one stop phase position wherein the drawing strips cooperate with the drawing grooves to create a a stop bead in the metal sheet, stop bead having a larger bead depth than the drawing bead; and at least one interchangeable distance piece located between the counterpressure plate and the drawing strip for the purpose of setting the bead depth of the drawing bead during the drawing phase.

3. A deep-drawing apparatus for metal sheets, comprising:

a table and a press, said press operative to move in a reciprocal manner between a first position and a second position;

a drawing punch, a drawing die, a counterpressure plate located between said table and said press;

a plurality of drawing strips having an upper surface mounted in the counterpressure plate for movement in the direction of the press;

drawing grooves having a groove base in the drawing die and into which the drawing strips can be incrementally moved to maintain a gap between said upper surface of said drawing strip and said groove base of said drawing grooves; and said drawing strips operative to move between a drawing bead position wherein the drawing strips cooperate with the drawing grooves to create a drawing bead in the metal sheet and at least one stop phase position wherein the drawing strips cooperate with the drawing grooves to create a stop bead in the metal sheet, the stop bead having a larger bead depth than the drawing bead; and at least one interchangeable distance piece located between the counterpressure plate and the drawing strip for the purpose of setting the bead depth of the drawing bead during the drawing phase wherein a pressure pin is arranged offset from the distance piece between the drawing strip and the table, and wherein a pressure force can be transmitted between the table and the drawing strip by the pressure pin.

4. The deep-drawing apparatus as claimed in claim 3, wherein the pressure pin is clamped in place between the table and the drawing strip during the stop phase and is free of pressure during the drawing phase, since the distance between the table and the drawing strip during the drawing phase is greater than the length of the pressure pin.

5. The deep-drawing apparatus as claimed in either of claims 3 or 4, wherein at least one distance element is provided which is arranged in addition to the pressure pin between the table and the drawing strip.

6. The deep-drawing apparatus as claimed in claim 5, wherein the distance element provided is a further distance piece having a fixed distance dimension or a distance device having an adjustable distance dimension.

7. The deep-drawing apparatus as claimed in claim 3, wherein the pressure pin is mounted in the counterpressure plate such as to be axially movable, namely movable parallel to the press direction of the press.

8. The deep-drawing apparatus as claimed in claim 5, wherein at least one further distance element is arranged between the table and the drawing strip at both ends of the pressure pin.

9. The deep-drawing apparatus as claimed in claim 6, wherein the drawing height, by means of the distance pieces which can be used in a variable manner, and the stopping height, by means of the further distance pieces or the distance devices, can be set independently of one another.

* * * * *